US012252957B2

(12) United States Patent
AlRabaei et al.

(10) Patent No.: US 12,252,957 B2
(45) Date of Patent: Mar. 18, 2025

(54) PRESSURE-PULSING FOR EFFECTIVE MUDCAKE REMOVAL

(71) Applicant: SAUDI ARABIAN OIL COMPANY, Dhahran (SA)

(72) Inventors: Rayan A. AlRabaei, Jeddah (SA); Abdulhamid N. AlSousy, Dhahran (SA); Akram R. AlBarghouti, Dammam (SA); Mohammed H. AlKhaldi, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 98 days.

(21) Appl. No.: 17/649,121

(22) Filed: Jan. 27, 2022

(65) Prior Publication Data

US 2023/0235645 A1 Jul. 27, 2023

(51) Int. Cl.

| | |
|---|---|
| ***E21B 34/02*** | (2006.01) |
| ***E21B 37/00*** | (2006.01) |
| ***E21B 43/12*** | (2006.01) |

(52) U.S. Cl.

CPC ..... *E21B 34/025* (2020.05); *E21B 37/00* (2013.01); *E21B 43/12* (2013.01)

(58) Field of Classification Search

CPC ..... E21B 24/00; E21B 24/02; E21B 24/025; E21B 43/12; E21B 37/00; E21B 37/06; F16K 47/08

See application file for complete search history.

(56) References Cited

U.S. PATENT DOCUMENTS

| | | | | |
|---|---|---|---|---|
| 2,286,835 | A * | 6/1942 | Robinson | E21B 37/00 166/295 |
| 5,375,661 | A * | 12/1994 | Daneshy | E21B 43/14 166/278 |
| 5,676,213 | A | 10/1997 | Auzerais et al. | |
| 6,527,050 | B1 | 3/2003 | Sask | |
| 6,598,682 | B2 | 7/2003 | Johnson et al. | |
| 6,668,943 | B1 * | 12/2003 | Maus | E21B 43/122 175/48 |
| 7,992,656 | B2 | 8/2011 | Dusterhoft et al. | |
| 10,683,739 | B2 | 6/2020 | Nguyen et al. | |
| 2005/0072565 | A1 * | 4/2005 | Segura | E21B 49/10 166/100 |
| 2006/0137879 | A1 | 6/2006 | Chan | |
| 2009/0165548 | A1 * | 7/2009 | Pop | E21B 49/008 73/152.51 |

(Continued)

*Primary Examiner* — George S Gray

(74) *Attorney, Agent, or Firm* — Osha Bergman Watanabe & Burton LLP

(57) ABSTRACT

A method for clearing an obstruction in a wellbore may include opening a first choke that is in fluid communication with the wellbore. This may create a first pressure in the wellbore. The first choke may then be closed. If the choke is adjustable, the choke size may be adjusted to a second size and opened. If the choke is fixed, a second choke of a different size is then opened. When the second choke is opened, a second pressure may be created in the wellbore that is different from the first pressure. The second choke may then be closed. For an adjustable choke, the size is changed to either the first size or a third size. For a fixed choke, either the first choke or a third choke that has a different size may be opened. These steps may be repeated until the obstruction in the wellbore is cleared.

12 Claims, 5 Drawing Sheets

(56) References Cited

U.S. PATENT DOCUMENTS

| | | | | |
|---|---|---|---|---|
| 2009/0283265 | A1* | 11/2009 | Maxit | E21B 49/0875 166/69 |
| 2012/0253679 | A1* | 10/2012 | Chang | E21B 49/088 73/152.24 |
| 2019/0203567 | A1 | 7/2019 | Ross et al. | |
| 2021/0003003 | A1 | 1/2021 | Proett et al. | |
| 2021/0348493 | A1* | 11/2021 | Aziz | E21B 7/04 |
| 2022/0275713 | A1* | 9/2022 | Calvert | E21B 43/00 |
| 2022/0349298 | A1* | 11/2022 | Thiruvenkatanathan | E21B 47/135 |

* cited by examiner

PRESSURE-PULSING FOR EFFECTIVE MUDCAKE REMOVAL

BACKGROUND

Newly drilled wellbore cleanout and mudcake removal from a wellbore are common challenges faced in oil & gas operations. Both chemical and mechanical techniques are used to remove mudcake, debris, and other solid buildups from an obstructed or constricted wellbore. Among conventional techniques, acid systems are extensively used for their availability, ease of operation, and effectiveness in wellbore cleanout and mudcake removal. One of the many challenges associated with these acid treatments is fast acid reaction, especially at deep hot formations. This fast reaction may lead to face dissolution and premature fluid leak-offs which negatively affect the treatment efficiency, especially in a long horizontal well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for clearing an obstruction in a wellbore. The method includes opening a first choke that is in fluid communication with the wellbore, such that a first pressure is created in the wellbore. Then, the first choke is closed. The method then includes opening a second choke that is in fluid communication with the wellbore. The second choke has a different size than the first choke, such that when the second choke is opened, a second pressure is created in the wellbore that is different from the first pressure. The second choke is then closed. The method then includes opening the first choke or a third choke that has a different size than the first choke and the second choke. The steps are repeated until the obstruction in the wellbore is cleared.

In another aspect, embodiments relate to a method of clearing an obstruction in a wellbore that includes opening an adjustable choke to a first choke size. The adjustable choke is in fluid communication with the wellbore such that a first pressure is created in the wellbore when it is opened. Then the adjustable choke is closed. The method then includes adjusting the adjustable choke to a second choke size such that the second choke size is either a larger choke size or a smaller choke size than the first choke size. The adjustable choke is then again opened so that it is in fluid communication with the wellbore, such that a second pressure is created in the wellbore. The adjustable choke is then closed. The steps are repeated until the obstruction is cleared.

Other aspects and advantages of the claimed subject matter will be apparent from the following description and the appended claims.

DETAILED DESCRIPTION

Figure 1:
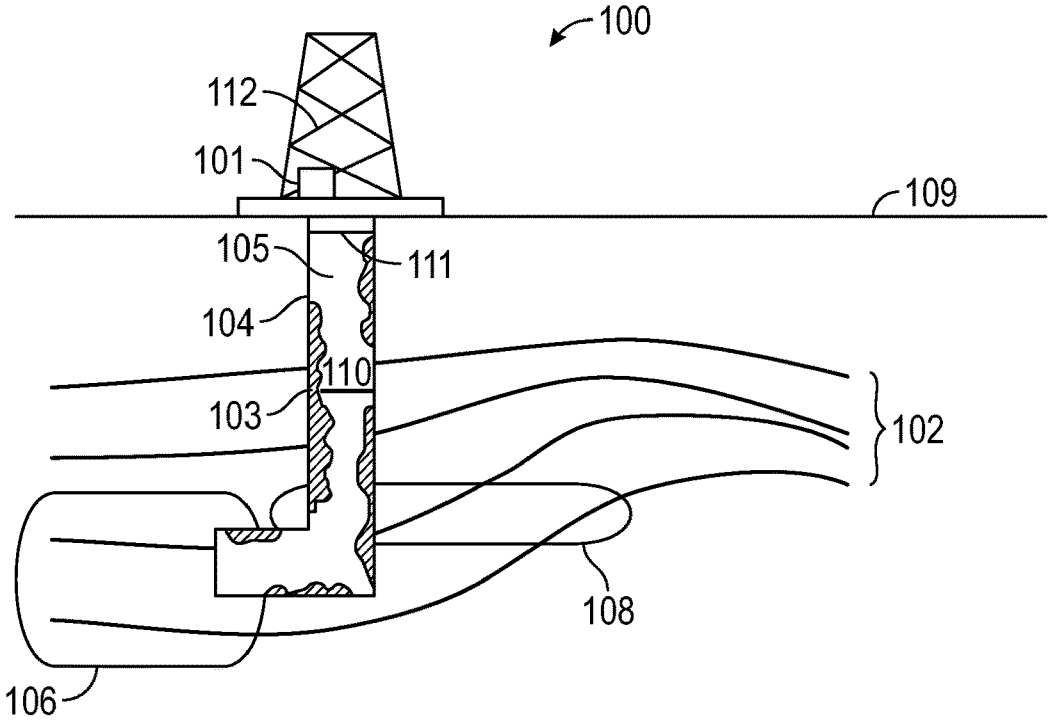
FIG. 1 is a schematic of an overall pressure pulsing system for wellbore cleanout and mudcake removal in a wellbore in accordance with one or more embodiments of the present disclosure.

Specific embodiments of the present disclosure will now be described in detail with reference to the accompanying figures. Like elements in the various figures are denoted by like reference numerals for consistency.

Numerous specific details are set forth in the following detailed description in order to provide a more thorough understanding of embodiments of the present disclosure. However, it will be apparent to one of ordinary skill in the art that the present disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create a particular ordering of the elements nor to limit any element to being only a single element unless expressly disclosed, such as by the use of the terms "before," "after," "single," and other such terminology. Rather the use of ordinal numbers is to distinguish between the elements. By way of an example, a first element is distinct from a second element, and the first element may encompass more than one element and succeed (or precede) the second element in an ordering of elements.

Definitions

As used herein, the term "solid content" means the amount of solid material per volume of extracted or produced fluid.

As used herein, the term "inherent reservoir pressure" means the hydrostatic pressure of fluids within the formations of a reservoir.

As used herein, the term "constricted wellbore" refers to a wellbore having a partial or complete blockage.

As used herein, "mudcake" means residue deposited on walls of a wellbore when a slurry, such as a drilling fluid, is forced against the wellbore wall under pressure.

As used herein, the terms "constricted," "obstructed," and "clogged" may be used interchangeably.

As used herein, the term "produced fluid" means the extracted fluid from a reservoir that may contain injection fluid, fracturing fluid, solids from the reservoir, and other debris along with production fluid.

As used herein, "choke size" means the open orifice available for fluid flow inside a choke. This may be determined by the ratio of the closed flow path and fully open flow path.

System and Method of Wellbore Cleanout

Hydrocarbon fluids are located below the surface of the Earth in subterranean porous rock hydrocarbon-bearing formations called reservoirs. In order to extract the hydrocarbons, wells may be drilled and cleaned out to gain access to the hydrocarbon-bearing formations. Once the wellbore is established, oil is extracted from the formations. During the operations, the well may become clogged by solid buildup in the wellbore. Such obstructions in the wellbore require cleaning prior to continuing further operations.

An example of a common solid buildup in the wellbore is mudcake. Mudcake is made up of various chemical contents including starches, polymers, and weighting materials (e.g., $CaCO_3$ and portions of used fracturing fluid, for example). While mudcake buildup on the walls of a wellbore is a normal part of drilling operations, obstructions in the wellbore due to excessive mudcake can be detrimental to oil and gas operations. Wellbore damage caused by mudcake results in time loss, and therefore, economic loss during drilling and related oilfield operations, especially in deviated and horizontal wells. Conventionally, it takes days to clean out a wellbore and resume operations, and harsh chemicals such as acids are typically used. In some cases where the obstruction cannot be cleared, the wellbore may become abandoned. Additionally, solids anywhere in the wellbore may damage other operational tools, a few examples of which are tubular strings, sensors, and injectors. Further, an obstructed, or constricted wellbore results in reduced fluid velocity within the wellbore, which may also result in time and economic losses.

Accordingly, there is a need for techniques for wellbore cleanout and mudcake cleaning that do not require harsh chemicals, are cost-effective, have excellent cleaning performance, and do not require long periods of time to be effective.

The present disclosure generally relates to a technique for removing obstructions in a wellbore. The disclosed method includes pressure-pulsing that allows for the effective removal of mudcake without the use of harsh acidic fluids. This can be achieved by subjecting the horizontal open-hole wellbore to flow back of the formation fluids for a period of time that is sufficient to remove a substantial portion of mudcake from the walls of the wellbore. The inherent reservoir pressure is used to allow for well flow back, and by using an adjustable choke manifold, a cyclic iteration of high and low choke sizes, the applied pressure difference across the mudcake attached to the walls of the wellbore can be significantly changed into low and high values cycles, resulting in breaking of the mudcake. This technique provides pressure pulses across the mudcake which may shatter the mudcake and thereby remove it with produced formation fluid. Once the well is treated with pressure pulsing technique, the well can be used for normal oil production operations.

FIG. 1 shows an example of an oil production facility 100 in accordance with one or more embodiments of the present disclosure. The oil production facility 100 is located above a hydrocarbon reservoir 102 which may include an oil rig 112 and an oil well 104 to extract hydrocarbons 108. The oil rig 112 may include a choke manifold 101 in fluid communication with a target zone of formation 106 through the wellbore 104. The wellbore 104 includes a bored hole (i.e., a borehole) that extends from the surface 109 towards a target zone of the formation 106. During drilling operations, drilling fluid is circulated through the wellbore 104 to facilitate smooth drilling operations. During production operations, substances (e.g., water and other chemicals used for oil recovery) are injected into the wellbore 104 and travel to the target zone of the formation 106. Due to well damage or solid accumulation within the wellbore 104 during operation, mudcake 103 may accumulate on the surface of the wellbore 104. While some mudcake 103 buildup is a part of normal oil and gas operations, excessive or uneven mudcake can obstruct the free flow passage 105 in the wellbore 104. As shown in FIG. 1, the mudcake 103 may be unevenly distributed on the inner surface of the wellbore 104.

In one or more embodiments, the degree of constriction in the wellbore 104 may be determined by comparing the cross-sectional area of an annular cross-section taken in that constricted region 110 with the cross-sectional area of an annular cross-section of an unobstructed wellbore 111. In other embodiments, the degree of constriction in the wellbore 104 may be determined by comparing the fluid flow rate within a constricted region 110 of a wellbore with the fluid flow rate in an unobstructed wellbore. The degree of constriction may be determined on a relative basis compared to the wellbore under normal operation without constriction. A high relative constriction compared to an unobstructed wellbore may indicate a high differential pressure may be needed in order to remove mudcake from the wellbore. Therefore, as described in detail below, the pressures (and therefore corresponding choke sizes) may be selected based on relative constriction.

A constricted wellbore may have a decrease in fluid velocity, an increase in pressure and thus result in wellbore damage such as a partial collapse. A constricted wellbore may be caused by particulate buildup or inflow, filter cake buildup, and the like. Examples of an undesirably constricted area include a ledge, attached debris, and/or a build-up of filter cake along at least a portion of the wellbore wall. The constricted wellbore may require increased fluid circulation or other remedial action to reduce/remove the build-up. Standard data collected during drilling operations may be used to estimate the amount of constriction in the well.

Accordingly, one or more embodiments disclosed herein relate to at least a choke manifold, a wellbore, and a method of creating pressure pulses in a wellbore utilizing at least one choke with varying choke sizes to remove obstructions in a wellbore. Additionally, other processes for pressure-lifting may be used in conjunction with embodiments disclosed herein.

Figure 2:
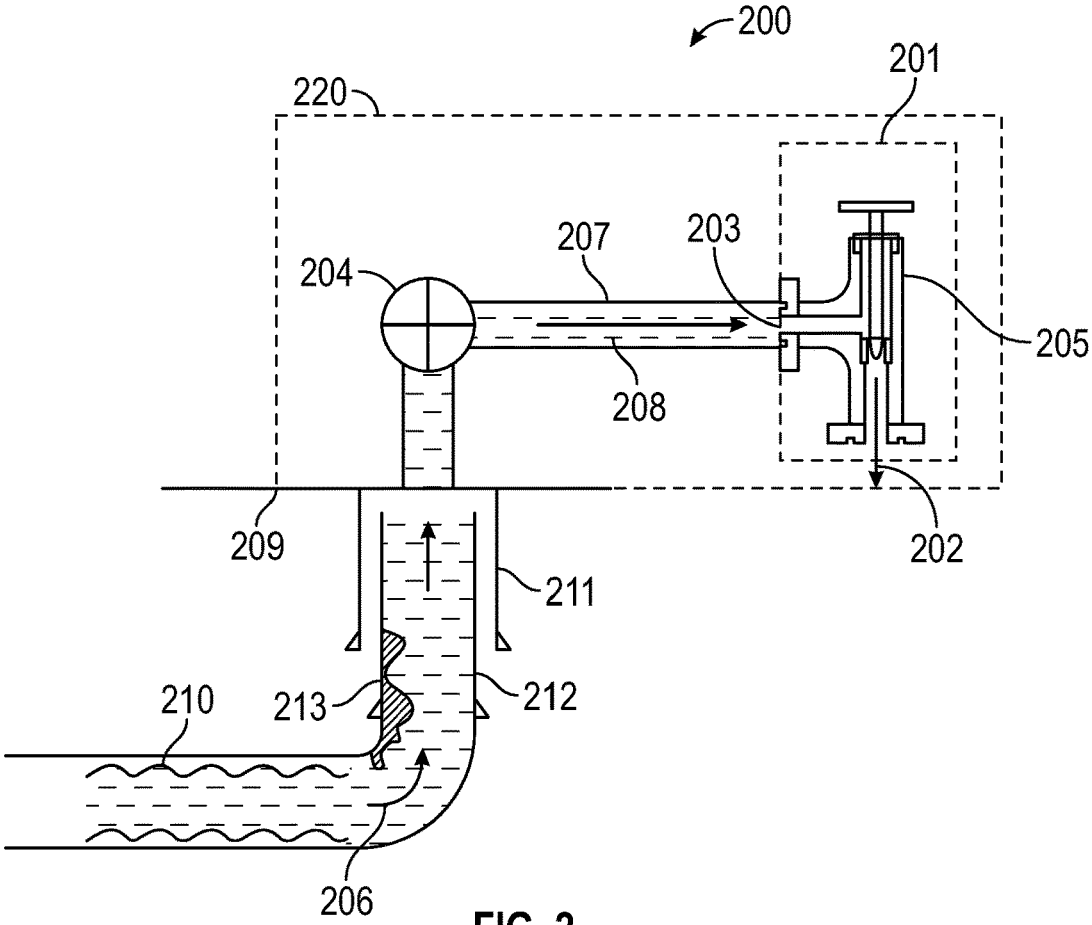
FIG. 2 is a schematic of a pressure pulsing system for wellbore cleanout and mudcake removal in a wellbore in accordance with one or more embodiments of the present disclosure.

FIG. 2 shows an expanded 200 view of the choke manifold 101 and pressure pulsing system for wellbore cleanout described in FIG. 1. This includes a choke manifold 220 located at the earth's surface 209 that is in fluid communication with the wellbore 211. The choke manifold is used to lower the pressure from the wellhead. In the choke manifold 220, at least one choke 201 is in fluid communication with a flow control valve 204 at the surface 209 through a piping segment 207. The control valve 204 is a production valve or master valve that is used to control the opening or closing of the well.

The choke 201 has three major areas: a body 205, an inlet 203, and an outlet 202. Using the choke manifold 220, pressure pulses 202 can be generated in the wellbore 212. These pressure pulses 210 first help break down the mudcake formation 213. Then the mudcake 213 is mixed with the production fluid 206. The production fluid 206 along with mudcake formation 213 may be extracted by conventional production fluid removal systems (not shown).

A choke is a device incorporating an orifice that is used to control fluid flow rate or downstream system pressure. Chokes are available in several configurations for both fixed and adjustable modes of operation. Adjustable chokes enable the fluid flow and pressure parameters to be changed to suit process or production requirements. Fixed chokes do not provide this flexibility, although they are more resistant to erosion under prolonged operation or the production of abrasive fluids.

In embodiments in accordance with the present disclosure, the choke may be fixed or adjustable. However, an adjustable choke may be advantageous as compared to a fixed choke as an adjustable choke may be more effective to apply pressure pulses of varying degrees. For the pressure pulsing techniques disclosed herein, a fixed choke with a large and small choke size may be utilized to create differential pressure, but the differential pressure required may vary from well to well depending on the wellbore conditions.

The choke 201 may be used to control flow rates and pressure drops of the produced fluids. For example, an operational function of the choke 201 at the surface 209 is to flow produced fluid 208 into the wellbore 211. In another example, an operational function of the choke 201 is to produce the fluids from the wellbore 211 at desired flow rates by manually controlling the drawdown pressure.

In some embodiments, the choke manifold 220 may include a set of high-pressure valves and at least two chokes (not shown). These chokes may be fixed or adjustable or a combination of both. Redundancy may be provided so that if one choke needs to be taken out of service, the flow can be directed through another choke.

The choke size determines the fluid flow rate or downstream system pressure. The choke size is represented by a number that is an equivalent orifice diameter in 1/64ths of an inch. For an example, and as will be described with reference to FIG. 4A and FIG. 4B, choke size 17/64" means the diameter of the bean 411 is 17 times of 1/64th of the orifice diameter 412.

Figure 3B:
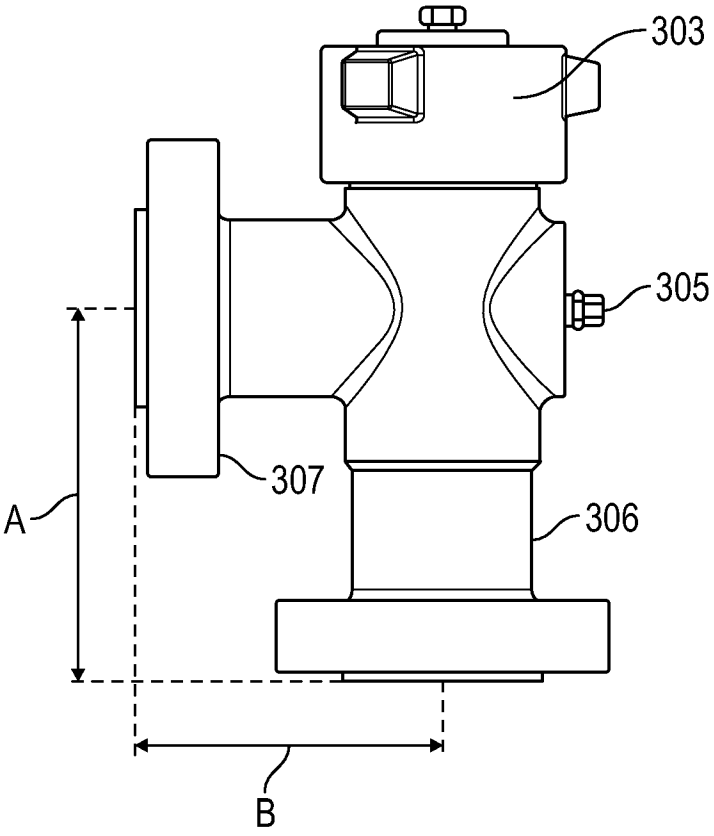
FIG. 3B is a side view of a fixed choke in accordance with one or more embodiments of the present disclosure.
Figure 3A:
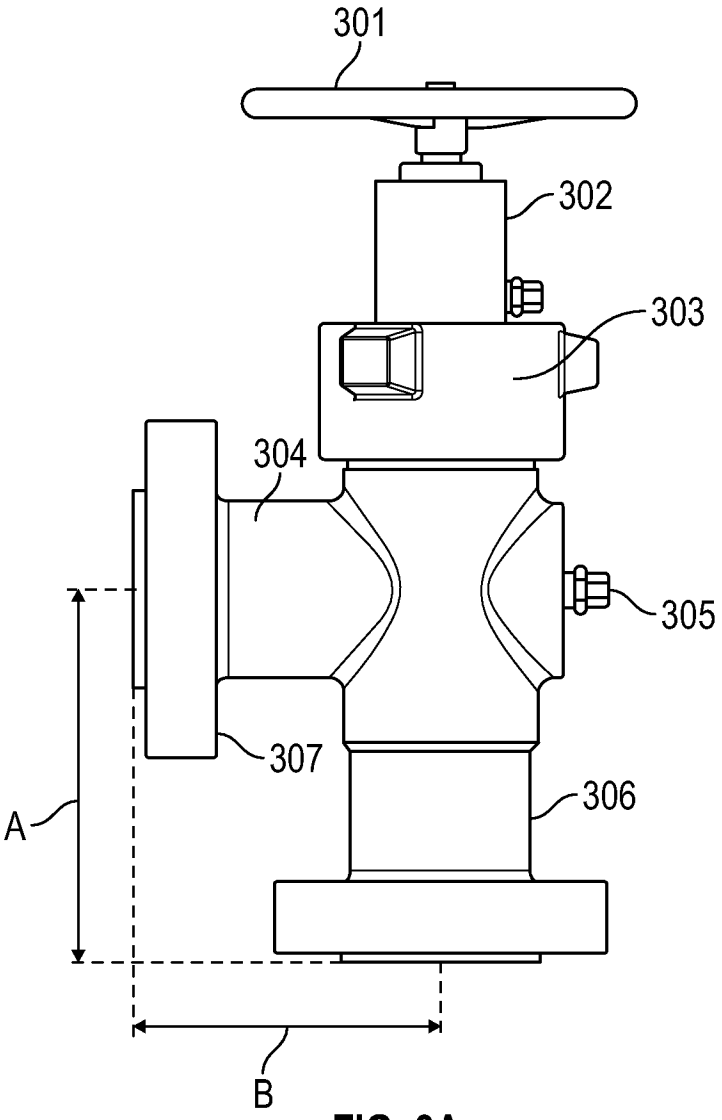
FIG. 3A is a side view of an adjustable choke in accordance with one or more embodiments of the present disclosure.

FIG. 3A shows a side view of an adjustable choke and FIG. 3B shows a side view of a fixed choke. For an adjustable choke, the choke size is adjustable to allow for the operator to adjust the amount of pressure dropped across the choke in order to maintain a downstream pressure in the production flow line. Thus, in one or more embodiments, the adjustable choke is used for adjusting the fluid flow rate.

In one or more embodiments, and as shown in FIG. 3A, the adjustable choke includes a handwheel 301, a thrust bearing 302, a graduated barrel 303, an inlet 304, a needle valve 305, an outlet 306, and flanges 307. A handwheel 301 is used to open and close the choke opening by either rotating counterclockwise or clockwise and therefore, the orifice diameter gets bigger or smaller. Heavy-duty thrust bearings 302 help reduce operating torque. A graduated barrel 303 has throttle bores, a graduated change in the inner diameter that determined the extent it restricts flow. Fluid from a wellbore flows into the choke through an inlet 304. A needle valve 305 has a small port and a threaded, needle-shaped plunger that allows precise regulation of flow through the choke. Once fluid passes through the choke, fluid pressure drops, and finally, the fluid is ejected through an outlet 306. A flange 307 is a cylindrical gate that interlinks the inlet and outlet.

In one or more embodiments, and as shown in FIG. 3B, the fixed choke includes all the parts similar to the adjustable choke described above, however, the fixed choke does not include a handwheel 301.

Figure 4B:
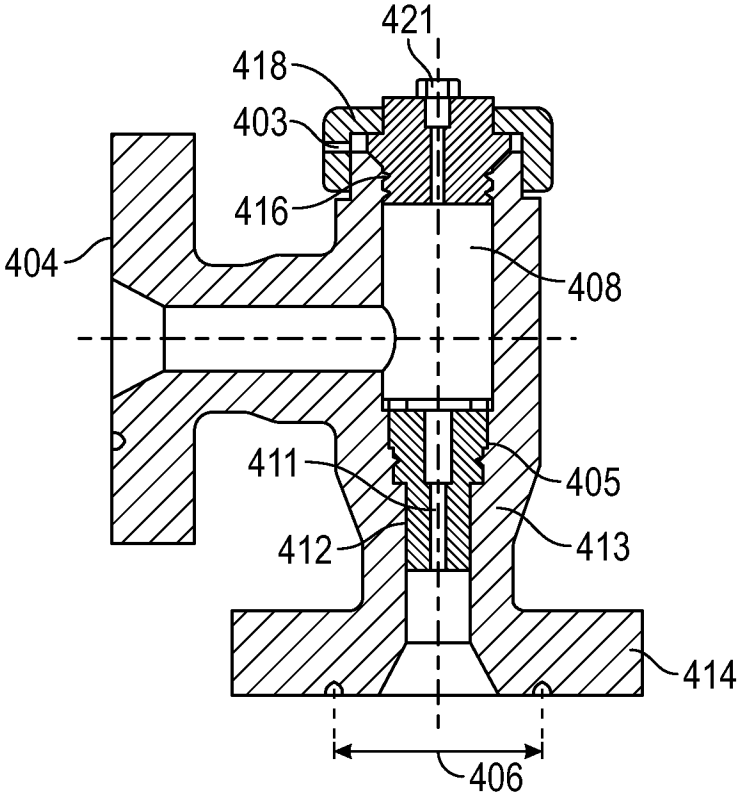
FIG. 4B is a cross-sectional view of a fixed choke in accordance with one or more embodiments of the present disclosure.
Figure 4A:
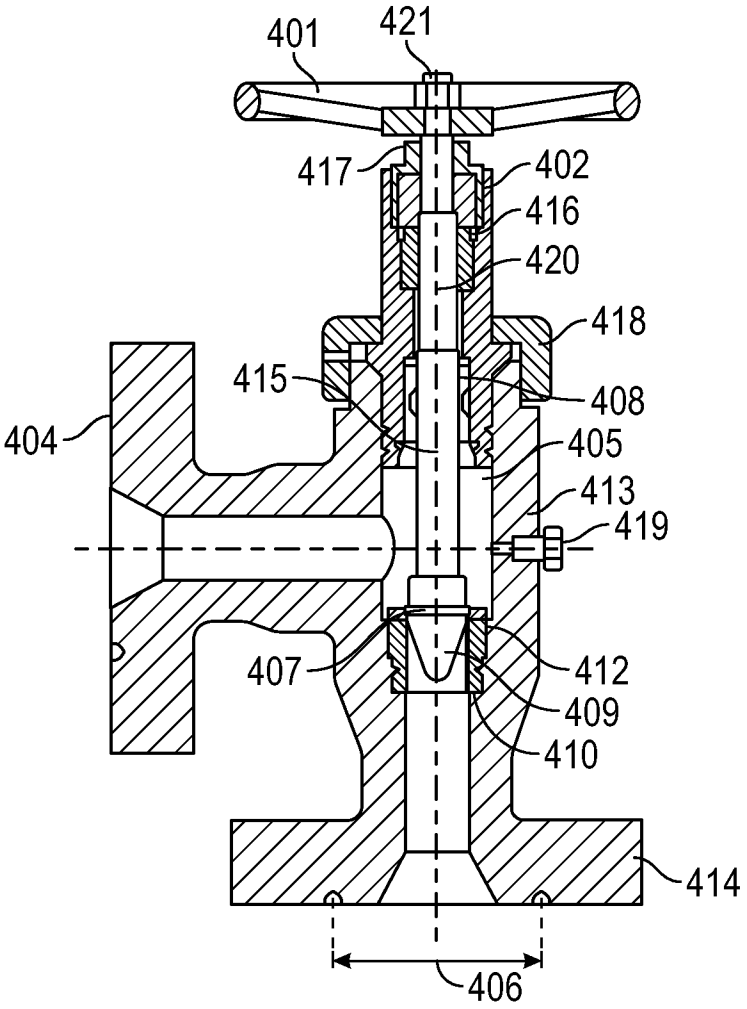
FIG. 4A is a cross-sectional view of an adjustable choke in accordance with one or more embodiments of the present disclosure.

FIG. 4A shows a cross-sectional view of an adjustable choke and FIG. 4B shows a cross-sectional view of a fixed choke. In one or more embodiments, and as shown in FIGS. 4A and 4B, the adjustable choke and the fixed choke both include an inlet 404 for passing fluid from the well into the choke, a metal body-to-bonnet gasket 405 for absolute pressure containment, an outlet 406 for passing fluid out of the choke at a lower pressure, a packing seal 408, a fully guided plug 409 that reduces side loading and vibration, an outer metal cage 413 that protects from impact damage, an outer flow cage 414 protects from impact damage, a bonnet 416, a bonnet nut 418, and a jam nut 421.

In one or more embodiments, and as shown in FIG. 4A, the adjustable choke includes a handwheel 401 to open and close the choke, thrust bearings 402, a rolling pin 403, a plug stem assembly 415, a plug 407, a stem tip 409, a tapered seat 410, a plug stem assembly 415, a position indicator 417, a body bleed port 419, and an upper stem 420. In one or more embodiments, the choke includes a bean 411 and an orifice 412. As described above, the size of the bean 411 and the orifice 412 determine the choke size.

Figure 5:
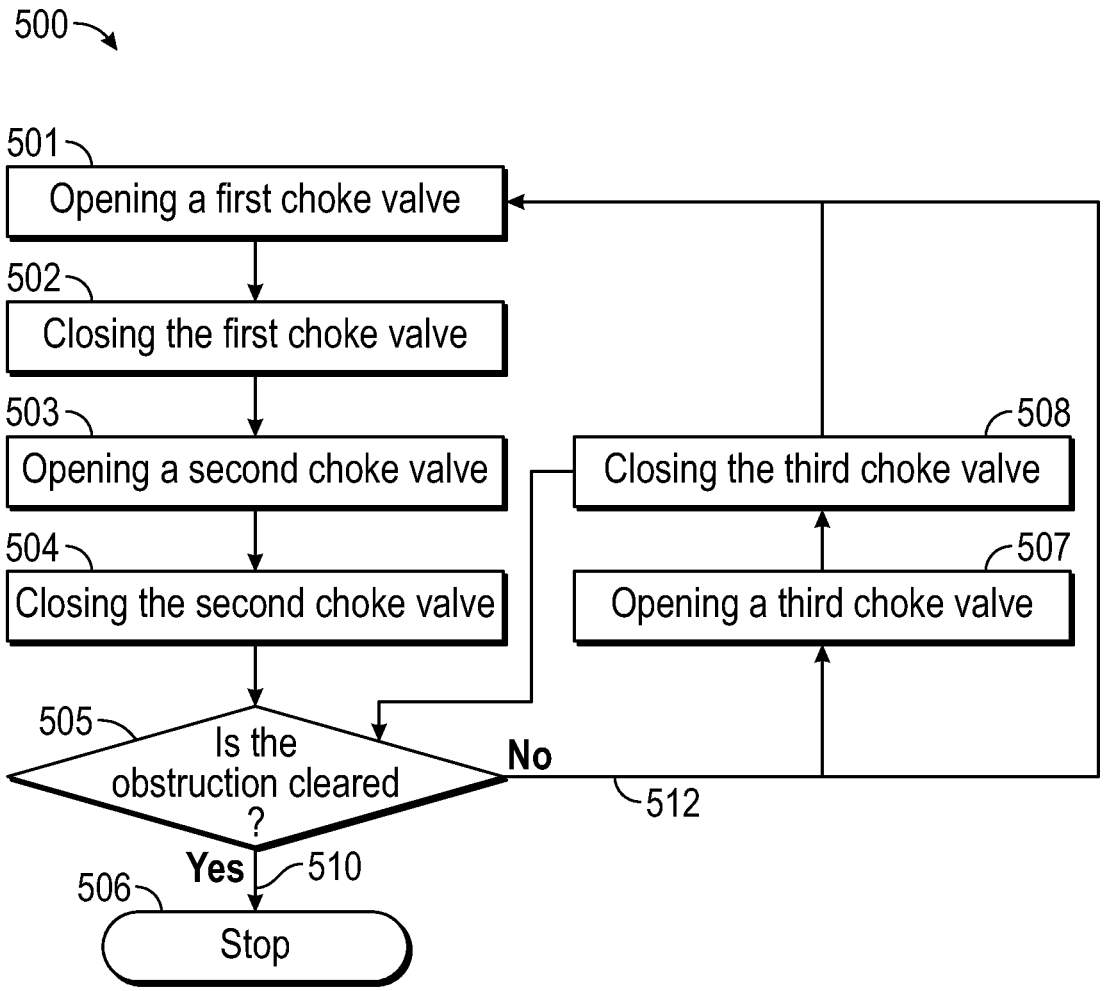
FIG. 5 is a block flow diagram of a method of removing an obstruction in accordance with one or more embodiments of the present disclosure.

Embodiments disclosed herein relate to methods of removing an obstruction that restricts either the injectivity or the productivity of the well. FIG. 5 shows a flowchart of a method 500 according to one or more embodiments. The flowchart depicts a method for performing pressure pulsing waves using at least two fixed chokes of two different sizes. Fixed chokes are described above in reference to FIGS. 3B and 4B. In one or more embodiments, one or more of the steps shown in FIG. 5 may be combined, omitted, repeated, and/or performed in a different order than the order shown in FIG. 5. Accordingly, the scope of the present disclosure should not be considered limited to the specific arrangement of steps shown in FIG. 5.

In one or more embodiments, a pressure pulse is generated by creating various pressures in the wellbore utilizing two fixed chokes of two different sizes. First, pressure is generated by first opening a specific sized fixed choke 501 that is in fluid communication with the wellbore. The first fixed choke is kept open before switching to the second choke until the flowing wellhead pressure is stabilized. Then the first fixed choke is closed 502. After replacing the first fixed choke with a second fixed choke, or after switching fluid communication to the wellbore from the first fixed choke to the second fixed choke, the second fixed choke is then opened 503 which creates a second pressure that is of a different value from the first pressure. The second fixed choke is then closed 504. Then, a measurement is performed to determine if the obstruction is cleared 505. The endpoint of the pressure pulsing method is when the obstruction is cleared and may be determined by taking fluid samples and monitoring the well performance. Indicators such as solid content in the produced fluid and wellbore pressure can be monitored to determine if the obstruction is cleared. As a non-limiting example, if solids production stops for a stabilized wellhead pressure and flow rate at a given choke size, then this is an indication of effective cleanup. If the obstruction is cleared 510, the operation is stopped 506. If the obstruction is not cleared 512, the second fixed choke is replaced with the first fixed choke. The first fixed choke is then opened 501, and the process is repeated. This creates a pressure pulse consisting of at least two specific pressure points that correspond to the size of fixed chokes utilized.

The process of opening, closing, and replacing the fixed choke may be repeated to create pressure pulses as described above until the obstruction in the wellbore is cleared. The operation is then stopped 506.

In one or more embodiments, the first fixed choke size is larger than the second fixed choke size. In such embodiments, the first pressure applied in the wellbore is smaller than the second pressure applied. In one or more embodiments, the first fixed choke size is smaller than the second fixed choke size. In such embodiments, the first pressure applied in the wellbore is larger than the second pressure applied.

In one or more embodiments, a pressure pulse is generated by creating various pressures in the wellbore utilizing three fixed chokes of three different sizes. In such embodiments, the method starts as described above with reference to the first and second chokes creating pressure pulses. If the obstruction is cleared 505 after the operation of the first and second chokes, the operation is stopped there 506. If the obstruction is not cleared 505, the second fixed choke is replaced with a third fixed choke of a different size. The third fixed choke is then opened 507 to create a third pressure that is of a different value from the first or the second pressure. The third fixed choke is then closed 508. If the obstruction is cleared 505, the operation is stopped there 506. If the obstruction is not cleared 505, the third fixed choke is replaced with the first fixed choke, and the first fixed choke is again opened 501, and the process is repeated. This creates a pressure pulse consisting of three specific pressure points that correspond to the size of fixed chokes utilized. The process of opening, closing, and replacing the fixed choke may be repeated to create pressure pulses as described above until the obstruction in the wellbore is cleared. The operation is then stopped 506.

In one or more particular embodiments, the fixed choke sizes vary as follows. A first fixed choke size is larger than a second fixed choke size, which is larger than a third fixed choke size. Therefore, the pressure points in a pressure pulse applied in the wellbore vary as follows. A first pressure is less than a second pressure which is less than a third pressure.

In one or more particular embodiments, the fixed choke sizes vary as follows. A first fixed choke size is less than a second fixed choke size which is less than a third fixed choke size. Therefore, the pressure points in a pressure pulse applied in the wellbore vary as follows. A first pressure is greater than a second pressure which is greater than a third pressure.

In one or more particular embodiments, the fixed choke sizes vary as follows. A first fixed choke size is less than a second fixed choke size which is greater than a third fixed choke. Therefore, the pressure points in a pressure pulse applied in the wellbore vary as follows. A first pressure is greater than a second pressure which is less than third pressure.

In one or more particular embodiments, the fixed choke sizes vary as follows. A first fixed choke size is greater than a second fixed choke size which is less than a third fixed choke size. Therefore, the pressure points in a pressure pulse applied in the wellbore vary as follows. A first pressure is less than a second pressure which is greater than third pressure.

In one or more embodiments, a pressure pulse is generated by creating various pressures in the wellbore utilizing more than three fixed chokes of at least three different sizes. The combinations of fixed chokes used can vary indefinitely, therefore, the pressure points in the pressure pulses do not follow any order. As may be appreciated by those skilled in the art, any possible number of fixed chokes may be used. Their sizes and resulting pressures may be selected based upon the desired pressure pulses. In one or more embodiments, the choke size to be utilized in a pressure pulsing technique may have a size of at least 5/64".

Figure 6:
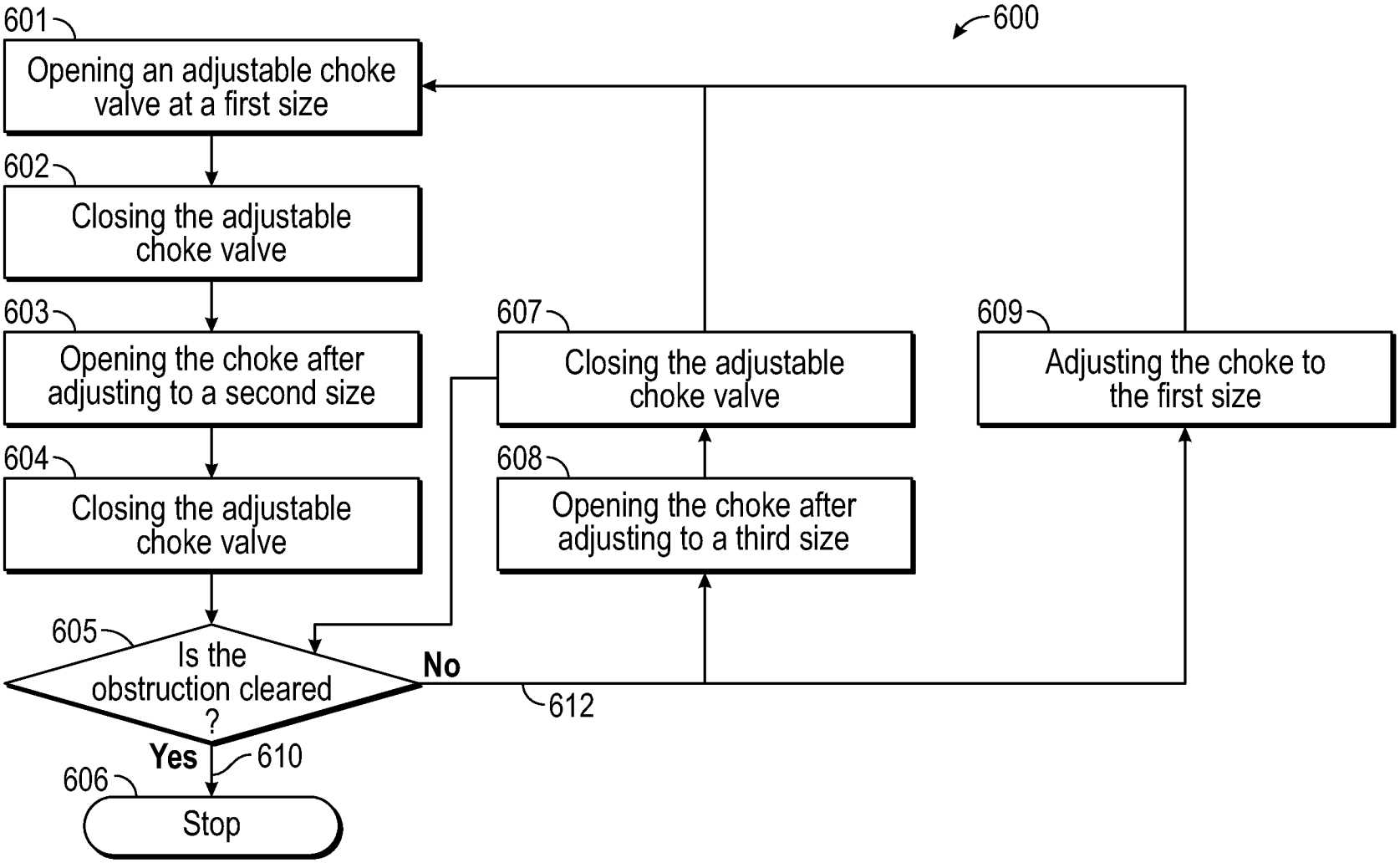
FIG. 6 is a block flow diagram of a method of removing an obstruction in accordance with one or more embodiments of the present disclosure.

FIG. 6 shows a flowchart of a method 600 for performing pressure pulsing waves using an adjustable choke in accordance with one or more embodiments. Adjustable chokes are described above in reference to FIGS. 3A and 4A. In one or more embodiments, one or more of the steps shown in FIG. 6 may be combined, omitted, repeated, and/or performed in a different order than the order shown in FIG. 6. Accordingly, the scope of the present disclosure should not be considered limited to the specific arrangement of steps shown in FIG. 6.

In one or more embodiments, a pressure pulse is generated by creating various pressure in the wellbore utilizing an adjustable choke. The adjustable choke is adjusted to have different choke sizes. Therefore, the corresponding pressure values created by the adjustable choke vary depending on the choke size.

In one or more embodiments, a pressure pulse is generated by creating at least two different pressures in the wellbore utilizing an adjustable choke. The first pressure is generated by first opening an adjustable choke 601 that is in fluid communication with the wellbore. Then the adjustable choke is closed 602. After adjusting the choke size of the adjustable choke to a second size, the adjustable choke is opened 603. This creates a second pressure that is of a different value from the first pressure. The adjustable choke is then closed 604. During operation, the chokes are opened and then closed based upon when the wellhead pressure is stabilized after opening or closing a choke. After step 604, a measurement is performed to determine if the obstruction is cleared 605. As described above with reference to the fixed choke system, indicators such as solid content in the produced fluid and wellbore pressure can be monitored to determine if the obstruction is cleared. If the obstruction is cleared 610, the operation is stopped 606. If the obstruction is not cleared 612, the adjustable choke size is changed to the first adjustable choke size 609, and the adjustable choke is then opened 601, and the process is repeated. This creates a pressure pulse consisting of at least two specific pressure points that correspond to the sizes of adjustable choke utilized. Furthermore, the process of opening, closing, and adjusting the choke size is repeated to create pressure pulses as described above until the obstruction in the wellbore is cleared. The operation is then stopped 606.

In one or more embodiments, a pressure pulse is generated by creating at least three different pressures in the wellbore utilizing an adjustable choke. The first two pressures are generated as described above. If the obstruction is cleared 610, the operation is stopped there 606. If the obstruction is not cleared 612, the adjustable choke size is changed to a third size 608. This creates a third pressure that is of a different value from the first or second pressure. The adjustable choke is then closed 607. If the obstruction is cleared 610, the operation is stopped there 606. If the obstruction is not cleared 612, the adjustable choke size is changed to the first size 609, and the process is repeated. This creates a pressure pulse including at least three specific pressure points that correspond to the sizes of adjustable choke utilized. Furthermore, the process of opening, closing, and adjusting the choke size is repeated to create pressure pulses as described above until the obstruction in the wellbore is cleared 610. The operation is then stopped 606.

In one or more embodiments, a pressure pulse is generated by creating various pressure in the wellbore utilizing more than three choke sizes with the adjustable choke. The combinations of adjustable choke sizes used can vary indefinitely, therefore, the pressure points in the pressure pulses do not follow any order. As may be appreciated by those skilled in the art, any possible number of choke sizes may be used in the adjustable choke. Their sizes and resulting pressures may be selected based upon the desired pressure pulses. The choke sizes and pressures created may vary, for example, as described above regarding the variation in choke size and pressure for the fixed choke system.

The choke size in accordance with one or more embodiments may be any suitable choke size to create a desired pressure in the wellbore. For an example, the choke size may range from 8/64" to 75/64". In one or more embodiments, the choke size maybe, 8/64", 16/64, or 75/64".

In one or more embodiments, a pressure pulse may be generated by utilizing a combination of an adjustable choke and at least one fixed choke. Choke manifold including multiple chokes (like a combination of fixed and adjustable chokes) may be arranged in parallel and utilized in these methods. In one or more particular embodiments, a wellbore obstruction may be cleared using only one choke size and applying pressure pulses.

In one or more embodiments, the pressure pulses applied to the wellbore using the choke(s) first break the mudcake or obstruction inside the wellbore wall. As the solid material from the obstruction is broken down, the solid content in the fluid rapidly increases due to the introduction of more solids into the produced fluid. As a result of the pressure-pulsing method described herein, the solid content in the wellbore fluid during cleanout may be higher than in conventional cleanout operations. A such, solids content in the produced fluid may be used as an indicator of the effectiveness of wellbore cleanout operations. Solid content may be determined by taking flowback samples from the site and using a centrifuge to separate the solid content from the collected sample, and measuring the volumes of the solid and the liquid, as is understood by those skilled in the art.

For example, in a conventional method, such as using acid for cleanout, the produced solids content maybe around 3 vol % of the produced fluid. In contrast, in an exemplary embodiment, using the pressure pulsing method described herein, the solids content may be greater than 70% after only 5 minutes of pressure pulsing. This increased solid content is an indication of increased effective wellbore cleanout as solids that were previously present in obstructions, such as mudcake, are in the wellbore fluid.

In one or more embodiments, the pressure pulsing method can be applied to any damage that restricts either the injectivity or the productivity of the well. Due to the difficulty of effective fluid placement, horizontal wells are challenging to clean with conventional methods. The methods described herein may be particularly useful for the cleanout of horizontal wells. As such, the mudcake removal treatment is completed much faster than the previously stated conventional method.

In the methods described herein, different pressure pulses can be generated when the inherent reservoir pressure is sufficient to create the required pressure draw-down to cause formation fluid flow-back. If the inherent reservoir pressure is not sufficient to create the required pressure draw-down, gas lifting may be used to aid the process. Thus, in some embodiments, a pressure pulsing method optionally relies on first applying a pressure draw-down on the well during flow back before executing any pressure-pulsing waves.

Pressure draw-down can be achieved by opening the well to flow to any flow back package which contains high-pressure accumulation vessels and sand management system (such as de-sander screen equipment). Furthermore, it is preferred that this flow-back package is always kept at a pressure lower than the well-head flowing pressure. In one or more embodiments, a nitrogen lifting method can further be used if sufficient pressure draw-down cannot be achieved. These pressure draw-down techniques are common practices understood by those skilled in the art and can be employed as necessary. Once the reservoir pressure is sufficient to create the required pressure draw-down to cause formation fluid flow-back, the previously described pressure-pulsing method may be employed.

In one or more embodiments, the pressure pulsing method may be followed by an acid cleaning step. In other embodiments, an acid cleaning step optionally may be employed before or after the pressure-pulsing method. Indeed, the pressure pulsing method may be readily adapted to use in conjunction with a variety of conventional wellbore treatments.

One or more of the embodiments disclosed herein may have one or more of the following advantages and improvements over conventional wellbore cleanout and mudcake removal systems. Less time may be required for wellbore cleanout and mudcake removal as compared to conventional methods, the disclosed method may be applicable under versatile wellbore conditions (e.g., high pressure, high temperature, high salinity environments), and the method may be simpler and more cost-effective and conventional treatments. The disclosed method may provide more control over wellbore cleanout and mudcake removal system as the pressure pulsing magnitude can be designed based upon inherent reservoir pressure, thus the technique can be tailored to a specific reservoir.

Additionally, data collected for specific wellbore cleanouts may be used to help estimate the time and cost associated with the cleanout of any wellbore. Data related to wellbore operations, such as fluid loss may be used as an indicator for designing a mudcake removal process. Therefore, this may improve the effectiveness of hydrocarbon recovery techniques.

EXAMPLES

The efficiency of the disclosed method was tested and successfully applied in several cleanouts of horizontal wells. Examples of pressure generated using different choke sizes in an adjustable choke in a wellbore according to embodiments of the present disclosure are shown in the table below.

| Choke Size | Applied Pressure |
|---|---|
| 16/64" | 700 psi |
| 75/64" | 300 psi |

In one exemplary case, a wellbore having a diameter of 6.125 inches and an open hole length of 6000 feet was tested for effective wellbore cleanout. The produced solids content during normal cleanout operation without applying the pressure pulsing was about 3% in the produced fluid. When the pressure pulsing was applied, the solids content increased after 5 minutes to more than 50%. Similarly, another well was open for flowback for several hours and the solids content was around 5%, 15 minutes after applying pressure pulses according to the present invention, the solids content increased to 40% of produced fluids. For the given example, utilizing this technique, the average duration of treated wells was reduced from 14 days to nearly 2-3 days. However, the average duration of treating a well using pressure pulsing technique may vary depending on the wellbore condition and properties.

Although the disclosure has been described with respect to only a limited number of embodiments, those skilled in the art, having the benefit of this disclosure, will appreciate that various other embodiments may be devised without departing from the scope of the present disclosure. Accordingly, the scope of the disclosure should be limited only by the attached claims.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112 (f) for any limitations of any of the claims herein, except for those in which the claim expressly uses the words 'means for' together with an associated function.

What is claimed:

1. A method of clearing a mudcake in a wellbore, the method comprising:

(a) opening a first choke having a size of 8/64", wherein the first choke is in fluid communication with the wellbore, such that a first pressure is created in the wellbore;

(b) closing the first choke;

(c) opening a second choke having a size of 16/64" or 75/64", wherein the second choke is in fluid communication with the wellbore, such that a second pressure is created in the wellbore, wherein the second pressure is different from the first pressure;

(d) closing the second choke;

(e) opening the first choke or a third choke, wherein the third choke has a size of 16/64" or 75/64" and has a different size than the first choke and the second choke; and repeating at least steps of (a) opening the first choke, (b) closing the first choke, (c) opening the second choke, (d) closing the second choke, and (e) opening the first choke or the third choke until the mudcake is cleared.

2. The method of claim 1, wherein the first pressure ranges from 300 psi to 700 psi, and the second pressure ranges from 300 psi to 700 psi.

3. The method of claim 1, further comprising, prior to opening the first choke introducing an acid solution into the wellbore.

4. The method of claim 1, wherein at least a portion of the wellbore is horizontal.

5. The method of claim 1, further comprising a pressure draw down step, wherein the pressure draw down step comprises using a pressure accumulation vessel.

6. The method of claim 1, further comprising a pressure draw down step, wherein the pressure draw down step comprises using a nitrogen lifting system.

7. A method of clearing a mudcake in a wellbore, the method comprising:

(a) opening an adjustable choke to a first choke size of 8/64", wherein the adjustable choke is in fluid communication with the wellbore, such that a first pressure is created in the wellbore;

(b) closing the adjustable choke;

(c) adjusting the adjustable choke to a second choke size of 16/64" or 75/64";

(d) opening the adjustable choke, wherein the adjustable choke is in fluid communication with the wellbore, such that a second pressure is created in the wellbore;

(e) closing the adjustable choke; and repeating steps of (a) opening the adjustable choke to the first choke size, (b) closing the adjustable choke, (c) adjusting the adjustable choke to the second choke size, (d) opening the adjustable choke, and (e) closing the adjustable choke until the obstruction is cleared.

8. The method of claim 7, wherein the first pressure ranges from 300 psi to 700 psi, and the second pressure ranges from 300 psi to 700 psi.

9. The method of claim 7, further comprising, prior to opening the adjustable choke introducing an acid solution into the wellbore.

10. The method of claim 7, wherein at least a portion of the wellbore is horizontal.

11. The method of claim 7, further comprising a pressure draw down step, wherein the pressure draw down step comprises using a pressure accumulation vessel.

12. The method of claim 7, further comprising a pressure draw down step, wherein the pressure draw down step comprises using a nitrogen lifting system.

* * * * *